US008695572B2

(12) United States Patent
Guido et al.

(10) Patent No.: US 8,695,572 B2
(45) Date of Patent: Apr. 15, 2014

(54) CONNECTION ARRANGEMENT FOR A TUBE LIKE FUEL LINE

(75) Inventors: Hans-Jurgen Guido, Neutraubling (DE); Jürgen Ernst, Atting (DE); Herrmann Wild, Regensburg (DE)

(73) Assignee: Hans-Jurgen Guido, Neutraubling (DE)

( * ) Notice: Subject to any disclaimer, the term of this patent is extended or adjusted under 35 U.S.C. 154(b) by 322 days.

(21) Appl. No.: 13/290,454

(22) Filed: Nov. 7, 2011

(65) Prior Publication Data

US 2012/0125462 A1 May 24, 2012

(30) Foreign Application Priority Data

Nov. 6, 2010 (DE) ..... 10 2010 050 296

(51) Int. Cl.
*F02M 61/14* (2006.01)
*F02F 11/00* (2006.01)

(52) U.S. Cl.
USPC ..... 123/468; 123/470; 277/591

(58) Field of Classification Search
USPC ..... 123/468, 469, 470; 277/591
See application file for complete search history.

(56) References Cited

U.S. PATENT DOCUMENTS

| | | | | |
|---|---|---|---|---|
| 3,845,748 A | | 11/1974 | Eisenberg | |
| 5,617,828 A | * | 4/1997 | Kuegel et al. | 123/468 |
| 5,775,303 A | * | 7/1998 | Sweetland et al. | 123/470 |
| 6,182,638 B1 | * | 2/2001 | Breitenberger | 123/468 |
| 6,279,540 B1 | * | 8/2001 | Greaney et al. | 123/470 |
| 6,431,150 B1 | * | 8/2002 | Pearlman et al. | 123/468 |
| 7,543,567 B2 | * | 6/2009 | Gibson et al. | 123/456 |
| 7,958,870 B2 | * | 6/2011 | Bonfigli et al. | 123/470 |

FOREIGN PATENT DOCUMENTS

| | | |
|---|---|---|
| DE | 697 08 542 T2 | 11/2001 |
| DE | 102 40 518 A1 | 11/2004 |
| EP | 2 354 529 A1 | 8/2011 |

OTHER PUBLICATIONS

Official Letter issued in German Patent Application No. 10 2010 050 296.0, dated Sep. 22, 2011.

* cited by examiner

*Primary Examiner* — Thomas Moulis
(74) *Attorney, Agent, or Firm* — Sughrue Mion, PLLC

(57) ABSTRACT

There is described a connecting arrangement for a fuel line (5) which extends through a passage (4) of a cylinder head (1) to a nozzle holder (2) to feed fuel to an injection nozzle. The fuel line has a pressure nipple (6) which on its front side has a sealing surface (8) and on its rear side a pressure receiving surface. A cap screw element (15) which surrounds the fuel line and is screwed to the inlet opening (3) of the passage projects into the passage with an axially directed tube portion (17) which in the tightened condition exerts on a pressure transmission arrangement a force which is directed axially towards the nozzle holder and which is transmitted to the pressure receiving surface of the pressure nipple to press its sealing surface against a counterpart sealing surface (10) on the nozzle holder. A sealing arrangement which seals off a first free space (21) between the outside wall of the fuel line and the inside wall of the pressure transmission arrangement and a second free space (22) between the outside wall of the pressure transmission arrangement and the inside wall of the passage relative to the exterior is positioned completely in the interior of the passage.

10 Claims, 5 Drawing Sheets

CONNECTION ARRANGEMENT FOR A TUBE LIKE FUEL LINE

Figure 1:
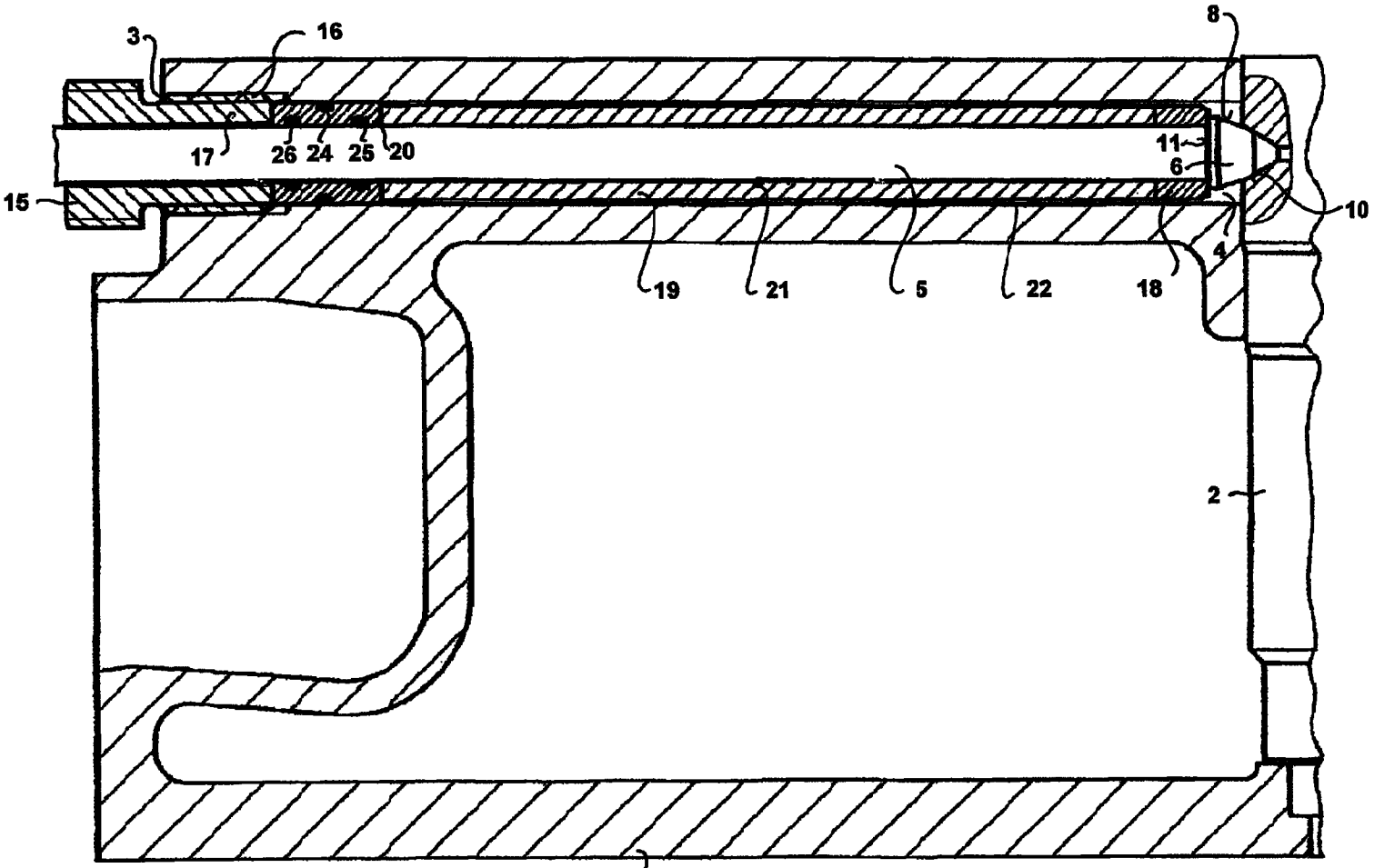

The invention concerns a connecting arrangement for a tubular fuel line of the kind set forth in the classifying portion of claim 1.

In such a connecting arrangement which can be found in U.S. Pat. No. 3,845,748 the sealing surface of a pressure nipple which is provided at the end of the fuel line, that is introduced into the passage in the cylinder head, is pressed by means of a pressure transmission arrangement against a counterpart sealing surface on the nozzle holder, transmitting to the pressure nipple the force which is produced when a cap screw element is screwed into a female screwthread in the region of the inlet opening of the passage and tightened therein. That pressure transmission arrangement comprises two parts coaxially surrounding the fuel line, namely a pressure ring bearing directly against a pressure receiving surface on the pressure nipple and a pressing tube which in the assembled condition bridges over the distance between the pressure ring and the cap screw element.

As the possibility cannot be excluded that engine oil and/or fuel under very high pressure penetrates into the free spaces which, for reasons of allowing assembly, must be present between the external peripheral surface of the fuel line and the pressure transmission arrangement on the one hand, and the pressure transmission arrangement and the inside wall of the passage on the other hand, it is necessary to seal off the passage towards the outside of the cylinder head to prevent uncontrolled escape of those fluids and/or the penetration of moisture into the free spaces.

For that purpose the known cap screw element has a prolonged shaft which in the fully screwed-in and tightened condition projects outwardly from the inlet opening of the passage and there carries a male screwthread, on which is fitted a nut which by being rotated can be moved in the axial direction towards or away from a flat contact surface surrounding the inlet opening of the passage on the outside of the cylinder head. Arranged on the shaft of the cap screw element between the contact surface and the flat side of the nut, that is towards it, is an annular sealing disk which is pressed against the contact surface when the nut is tightened with the cap screw element being fully screwed in. As the inside diameter of the sealing disk must be markedly larger than the outside diameter of the shaft of the cap screw element so that, when the nut is tightened, the sealing disk can move over the male screwthread on the shaft towards the contact surface on the cylinder head, a further annular sealing element is required, which is arranged between the nut and the male screwthread on the shaft.

That known sealing arrangement suffers from a series of disadvantages. It requires preliminary assembly of the cap screw element, on to which firstly the nut must be screwed together with the interposed annular sealing element and then the sealing disk has to be pushed on before the unit formed in that way can be positioned on the fuel line. If then the fuel line is introduced into the passage in the cylinder head until the pressure nipple bears against the counterpart sealing surface of the nozzle holder and the cap screw element is tightened, in addition the nut carried on the shaft of the cap screw element has to be tightened to achieve a sealed closure for the inlet opening of the passage. In that situation the sealing element between the nut and the male screwthread on the shaft causes difficulty both in terms of initially screwing on the nut on to the shaft and also the definitive tightening thereof.

In comparison the object of the invention is to develop a connecting arrangement of the kind set forth in the opening part of this specification such that sealing integrity that satisfies all demands in respect of the passage receiving the fuel line in the cylinder head can be achieved with a few parts of a simple structure and with a considerably simplified assembly procedure.

That object is attained by the features recited in claim 1.

The fact that the entire sealing arrangement according to the invention is no longer arranged outside the passage but in its interior means that its individual elements can be so designed and matched to each other that compression of the sealing elements, that is required for a good sealing effect which also withstands high pressures can be achieved solely and simply by tightening the cap screw element. The use and actuation of a further element to be tightened, as is represented by the nut in the known arrangement, are not necessary.

A further advantage of the positioning of the sealing arrangement according to the invention is that the parts of the connecting arrangement, which in the assembled condition are outside the cylinder head, have a very simple surface structure with a minimum of projections and recesses so that the risk of permanent dirt deposit in that region is reduced and any cleaning which may be required can be carried out easily and efficiently.

In a first embodiment the entire sealing integrity is afforded by means of a single, approximately hollow-cylindrical sealing sleeve which coaxially surrounds the tube of the fuel line and which is arranged between the cap screw element and the pressing tube in such a way that it transmits the force produced when the former is screwed into the female screwthread of the passage to the pressing tube which then transmits it by way of the pressure ring to the pressure nipple so that the latter is pressed with its pressure surface against the counterpart pressure surface of the nozzle holder. Provided in the wall of the sealing sleeve are at least one and preferably a plurality of peripherally extending grooves which start from the outer cylinder surface and at least one and preferably a plurality of peripherally extending grooves which start from the inner cylinder surface, into each of which is fitted a respective sealing ring projecting radially from its groove and consisting of an elastomer material. In the assembled condition the sealing ring or rings projecting beyond the outer cylinder surface then bear against the inside wall of the passage accommodating the fuel line and the sealing ring or rings projecting beyond the inner cylinder surface bear against the fuel line itself. In that way the two above-mentioned free spaces are automatically sealed off in the required fashion in relation to the outside of the cylinder head when the cap screw element is screwed in and tightened.

In another preferred variant the sealing sleeve has a first notch or rabbet in the transitional region between its one axial end and its outer peripheral wall and a second notch or rabbet in the transitional region between its other axial end and its inner peripheral wall. Fitted into each of those notches is a sealing ring comprising an elastomer material, which initially projects in the axial direction beyond the end in question and whose radial thickness is such that upon assembly it does not bear against the inside wall of the passage and the outside wall of the tubular fuel line respectively as long as no axially directed force is exerted on it. If then upon fitment the cap screw element is screwed into the passage to such an extent and tightened that the sealing sleeve is pressed by the inwardly directed end of the tube portion projecting into the passage against the end of the pressing tube, that is remote from the nozzle holder, then the sealing rings carried in the two notches are compressed in the axial direction and in that case at the same time expand in the radial direction to such an extent that they come into sealing contact both against the sealing sleeve and also the inside wall of the passage and the outside wall of the tubular fuel line respectively and thereby sealingly close the two above-mentioned free spaces.

A substantial advantage of that arrangement is that upon assembly no friction forces have to be overcome between the sealing rings and the inside wall of the passage and the outside wall of the tubular fuel line respectively because those parts come into contact with each other only upon definitive tightening of the cap screw element. That considerably facilitates assembly of a connecting arrangement of such a design configuration.

The same advantage can be achieved with a further sealing arrangement which is positioned according to the invention and which includes at least two circular annular disks of a rigid material, which concentrically surround the fuel line and of which one is of an inside diameter somewhat larger than the outside diameter of the fuel line and which on its outside periphery carries a sealing ring of an elastomer material, which initially projects in the axial direction beyond the two end faces of the annular disk and whose radial thickness is such that upon assembly it initially does not come to bear against the inside wall of the passage. Thus insertion of that annular disk which is carried on the fuel line into the passage does not involve the occurrence of any substantial frictional forces which could make the assembly procedure more difficult. The same also applies to the second annular disk whose outside diameter is somewhat smaller than the inside diameter of the passage and which, in its central opening surrounding the fuel line, carries a sealing ring of an elastomer material, which initially projects in the axial direction beyond the two end faces of the annular disk and whose radial thickness is such that upon assembly it initially does not come to bear against the outside wall of the fuel line. It should be expressly pointed out that advantageously it is also possible to use more than two such annular disks, in which case then an annular disk of the first-mentioned kind alternately follows an annular disk of the second kind in the axial direction. Here too upon definitive tightening of the cap screw element the two or more sealing rings are compressed in the axial direction and at the same time increased in size in the radial direction so that the required sealing integrity for the free spaces between the outside wall of the fuel line and the pressing tube on the one hand and the pressing tube and the inside wall of the passage on the other hand is achieved.

In a further embodiment of a sealing arrangement which is positioned according to the invention, a sealing sleeve which coaxially surrounds the fuel line has, only in its outer cylinder surface, one or more peripherally extending grooves into which is fitted a respective sealing ring of an elastomer material. Sealing integrity for the free space between the fuel line and the pressing tube is afforded here by a hollow-cylindrical sealing body of an elastomer material, which is fitted into the inwardly facing end portion of the inner bore of the cap screw element which is of an enlarged inside diameter to provide space for the hollow-cylindrical sealing body. It coaxially surrounds the fuel line and upon assembly does not initially come to bear thereagainst so that no substantial frictional forces have to be overcome in the assembly procedure. The sealing body firstly projects beyond the end of the cap screw element, that is towards the sealing sleeve, and upon tightening thereof is compressed in the axial direction by the end face of the sealing sleeve, that is towards it. In that case its wall thickness increases in the radial direction so that it comes into good sealing contact both against the fuel line and also the inside wall of the enlarged end portion of the inner bore in the cap screw element. In this embodiment also all sealing effects are afforded automatically upon tightening of the cap screw element without additional working or assembly steps being required.

In the variants described hereinbefore hermetic sealing of the passage accommodating the fuel line is in relation to the outside world. It may however be desirable for the arrangement to be such that fluid passing into the passage from the nozzle holder, for example fuel, can be carried away, as also illustrated in U.S. Pat. No. 3,845,748.

To implement such an arrangement in a further variant of the connecting arrangement according to the invention the above-mentioned sealing sleeve and annular disks are omitted so that in the assembly procedure the inwardly directed end of the cap screw element acts directly on the end of the pressing tube, that is remote from the nozzle holder. This situation also involves introducing into an end portion of the inner bore in the cap screw element which is of an enlarged inside diameter, a hollow-cylindrical sealing body of an elastomer material, which initially projects somewhat and which upon assembly comes to bear against the end face of the pressing tube, that faces towards it, and is compressed in the longitudinal direction upon tightening of the cap screw element in the above-described manner so that its wall thickness is increased in the radial direction and it sealingly closes off the free space between the outer peripheral surface of the fuel line and the inside wall of the pressing tube in relation to the outside of the cylinder head. The free space between the outer peripheral surface of the pressing tube and the inside wall of the passage accommodating the fuel line is sealed off by a sealing ring of elastomer material, which is fitted in a groove in the outer peripheral surface of the shaft of the cap screw element and which in the assembled condition is arranged in the axial direction on the side, that faces towards the inlet opening, of the female screwthread of the passage. Provided between that sealing ring and the female thread which does not form a sealed closure is an annular free space from which a fluid which penetrates into the passage from the nozzle holder can be sucked away.

These and other advantageous configurations of a connecting arrangement according to the invention are set forth in the appendant claims.

Figure 2:
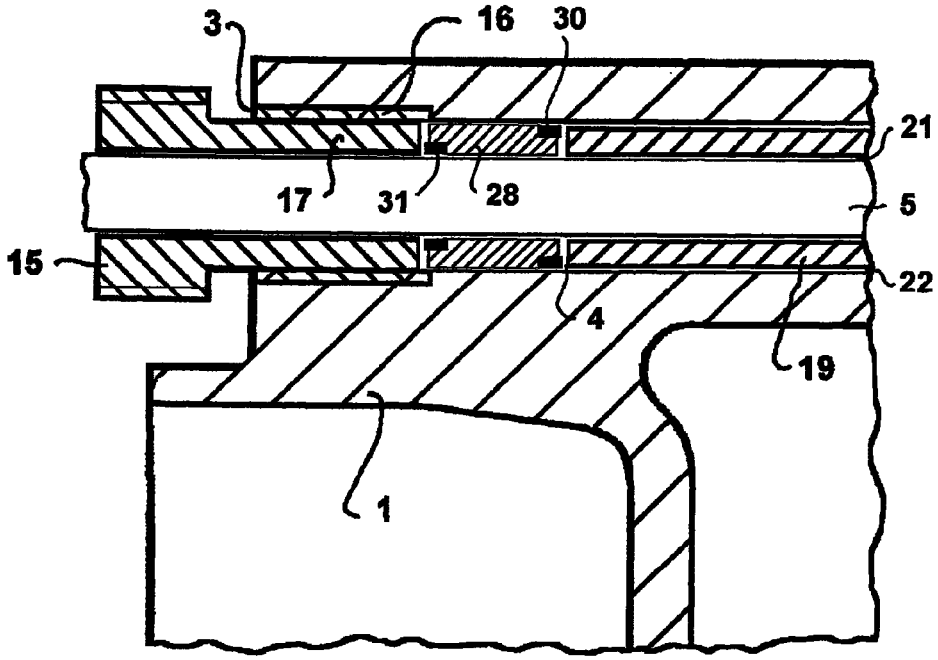
Figure 3:
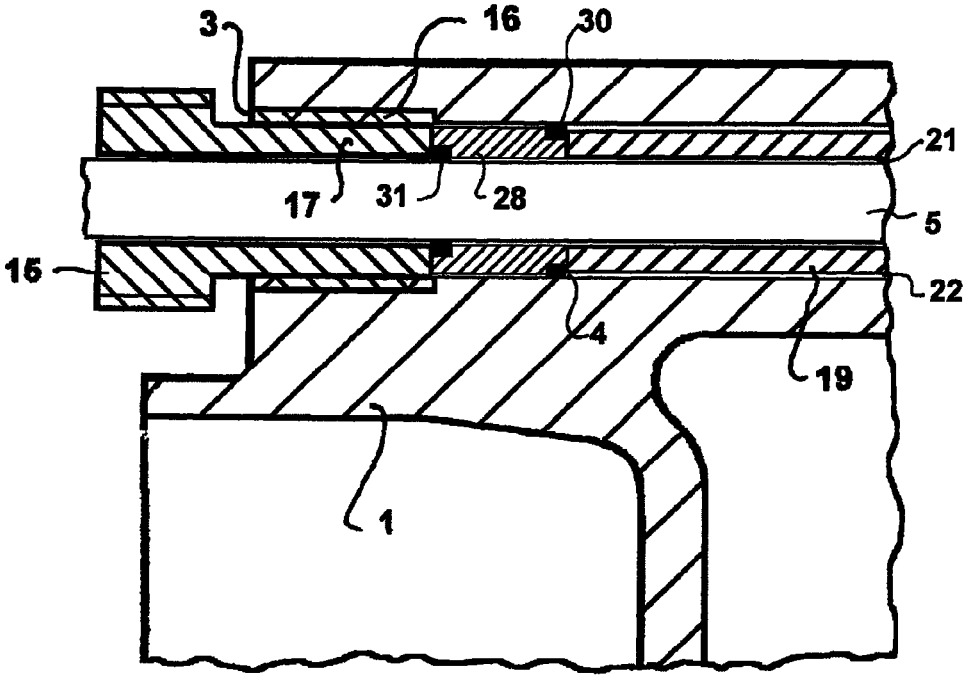
Figure 4:
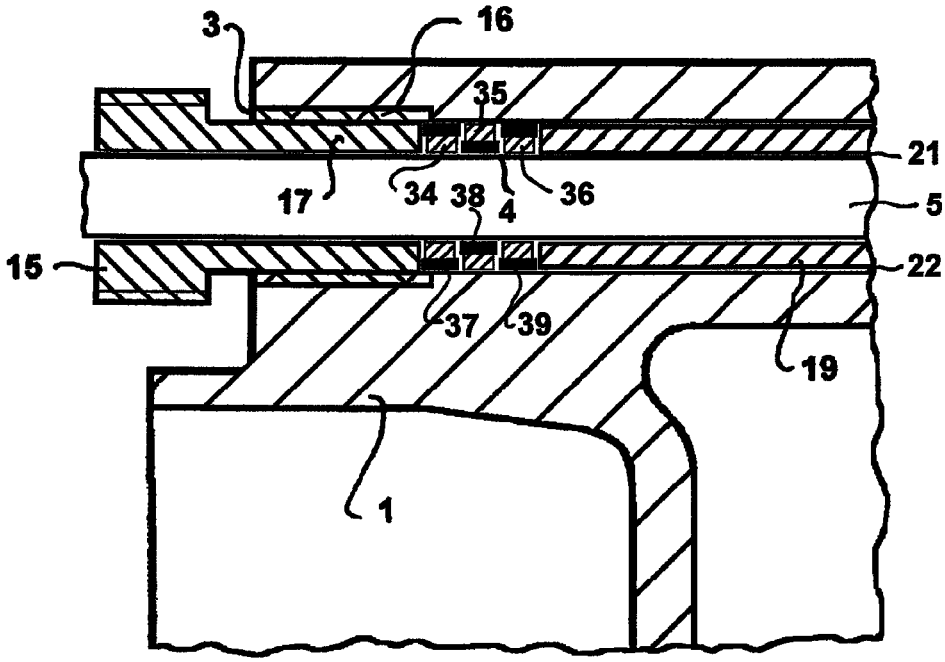
Figure 5:
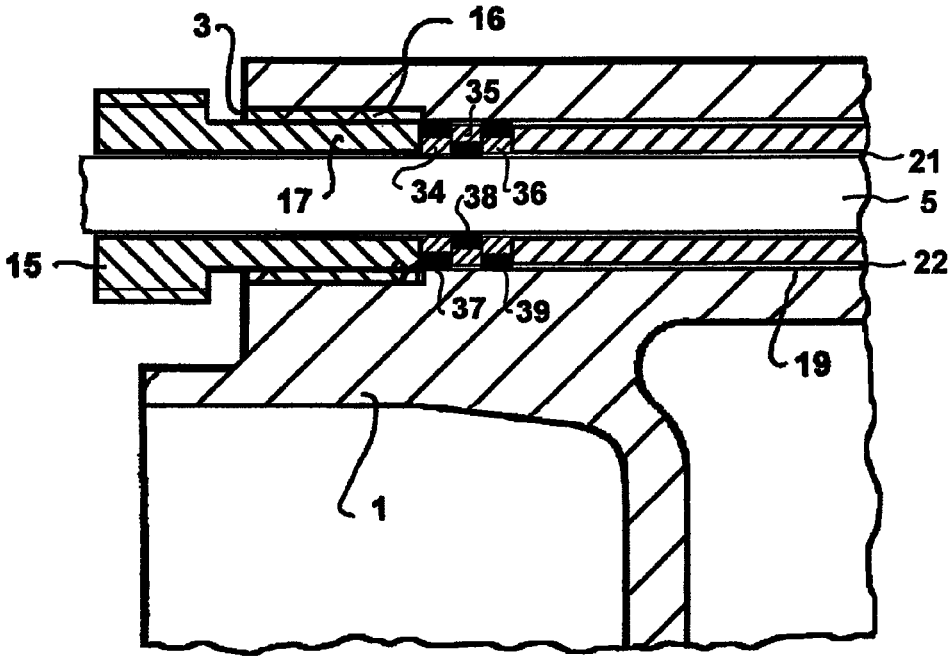
Figure 6:
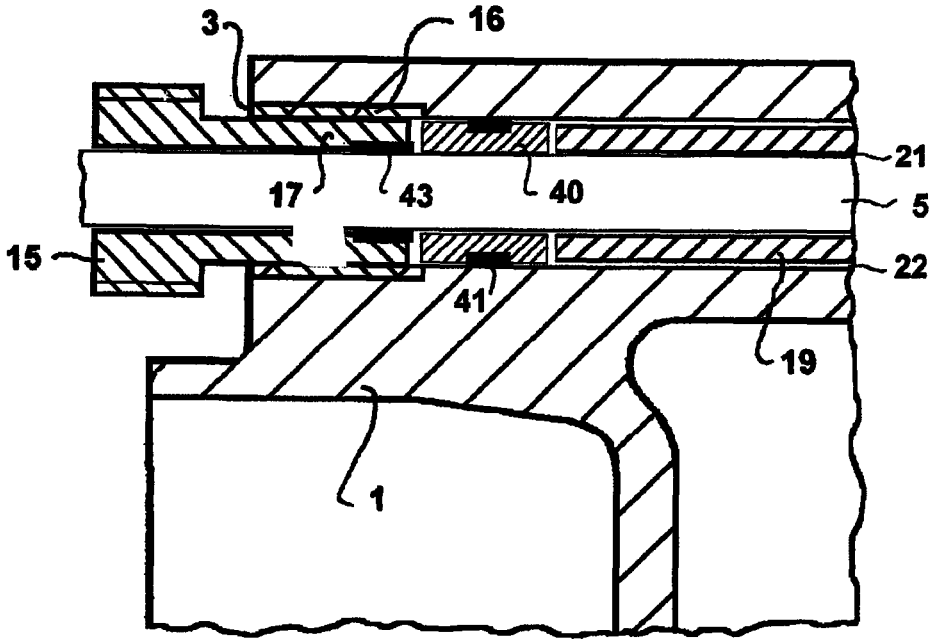
Figure 7:
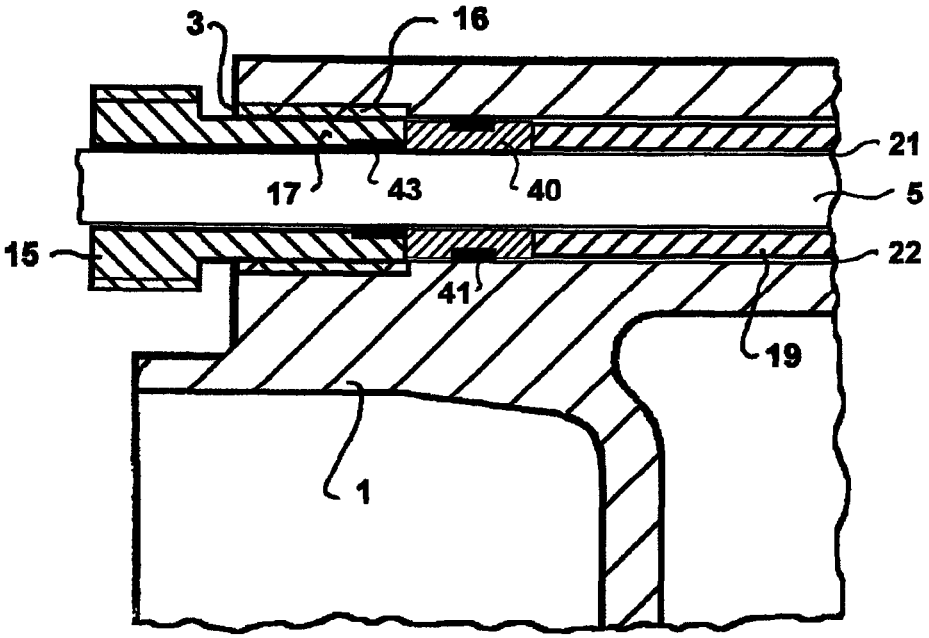
Figure 8:
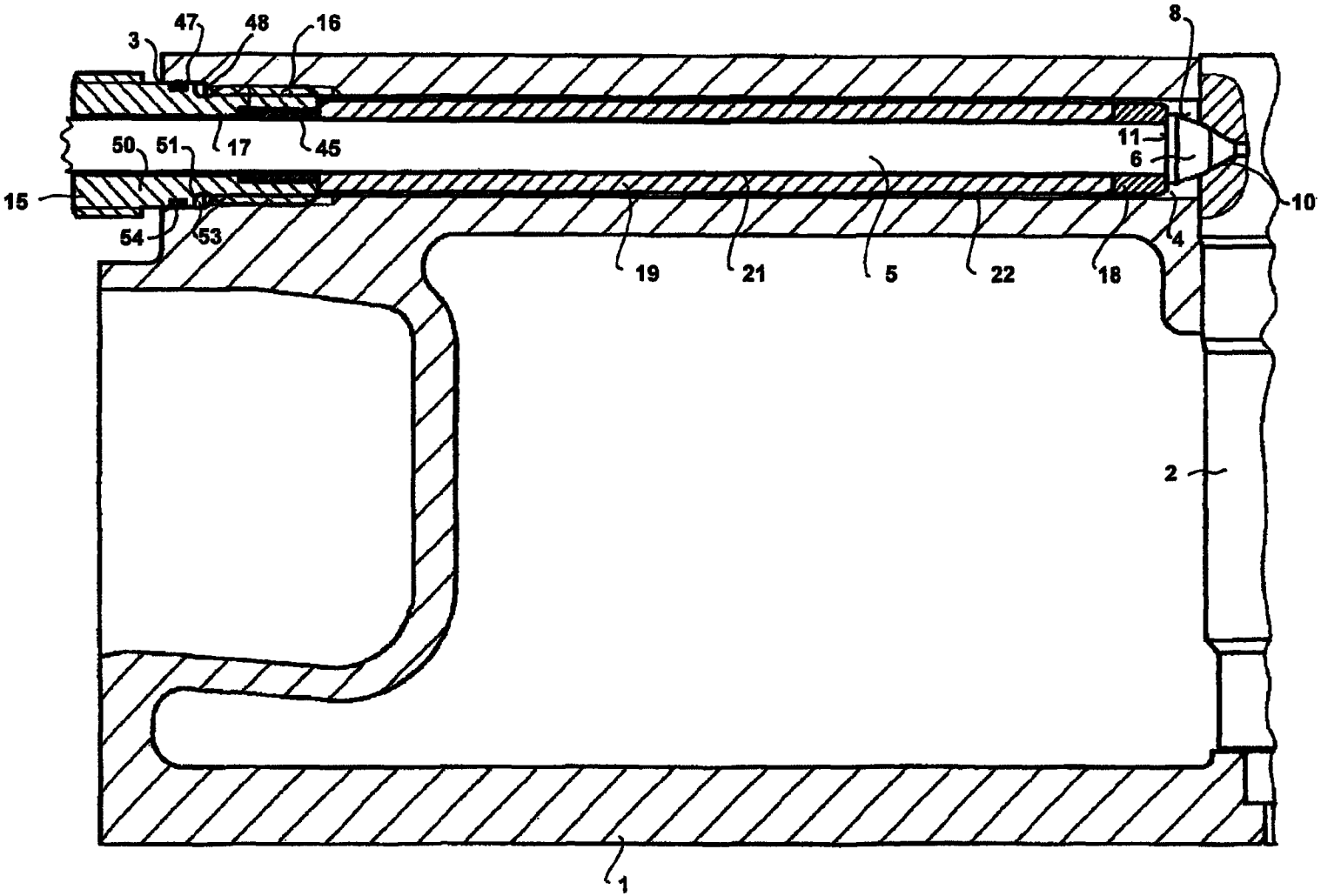

The invention is described hereinafter by means of embodiments by way of example with reference to the drawing in which:

FIG. 1 shows a diagrammatic section through a first embodiment of a connecting arrangement according to the invention, in which the sealing arrangement is formed by a sleeve arranged between the cap screw element and the pressing tube and coaxially surrounding the fuel line and sealing rings which are fitted into peripherally extending grooves in the sealing sleeve, FIG. 2 shows a detail view of a section corresponding to FIG. 1 through a second embodiment which is not yet in the finished assembled condition of a connecting arrangement according to the invention, in which the sealing arrangement is formed by a sealing sleeve arranged between the cap screw element and the pressing tube and coaxially surrounding the fuel line and sealing rings which are fitted into notches which are open at the end in the sealing sleeve, FIG. 3 shows the embodiment of FIG. 2 in the finished assembled condition, FIG. 4 shows a detail view of a section corresponding to FIG. 1 through a third embodiment which is not yet in the finished assembled condition of a connecting arrangement according to the invention, in which the sealing arrangement includes three annular disks concentrically surrounding the fuel line and arranged in axial succession between the cap screw element and the pressing tube, FIG. 5 shows the embodiment of FIG. 4 in the finished assembled condition, FIG. 6 shows a detail view of a section corresponding to FIG. 1 through a fourth embodiment which is not yet in the finished assembled condition of a connecting arrangement according to the invention, in which the sealing arrangement is formed by a sleeve arranged between the cap screw element and the pressing tube and coaxially surrounding the fuel line and a cylindrical sealing element which coaxially surrounds the fuel line and which is fitted into an enlargement, directed towards the nozzle holder, of the inner bore of the cap screw element, FIG. 7 shows the embodiment of FIG. 6 in the finished assembled condition, and FIG. 8 shows a section corresponding to FIG. 1 through a fifth embodiment of a connecting arrangement according to the invention in the finished assembled condition, in which the sealing arrangement is formed by a cylindrical sealing element coaxially surrounding the fuel line and fitted into an enlargement, directed towards the nozzle holder, of the inner bore of the cap screw element, and a sealing ring fitted into a groove extending in the peripheral direction in the outside wall of the tube portion.

In the Figures identical or mutually corresponding parts are denoted by the same references. If in the present text positional references such as 'left', 'right', 'top', 'bottom', 'vertical', 'horizontal' or the like are used they relate only to the views in the Figures and are not to be construed restrictively as a connecting arrangement according to the invention can assume widely varying positions in space.

FIG. 1 shows a diagrammatic section through a part of a cylinder head 1 having a vertically extending first bore into which a nozzle holder 2 or injector which is only partly shown is introduced from above and in which a nozzle for the injection of fuel into the combustion chamber of the cylinder in question is fitted in known manner.

Extending through the cylinder head perpendicularly to the first bore is a further horizontal bore of a substantially circular cross-section, forming a passage which extends from an inlet opening 3 opening towards the outside to the nozzle holder 2 and into which there is introduced from the left a fuel line 5 which is formed by a tube and which serves to feed the injection nozzle arranged in the nozzle holder 2 with fuel under high pressure. For that purpose, at its end towards the nozzle holder 2, the fuel line 5 has a pressure nipple 6 which is produced for example by upsetting thereon and which bears with a sealing surface 8 against a hollow-conical counterpart sealing surface 10 which is provided on the nozzle holder 2 and which surrounds the mouth opening of a fuel flow passage which extends further in the nozzle holder 2.

On its side axially opposite to the sealing surface 8 the pressure nipple 6 has a shoulder 11 which, by virtue of projecting radially beyond the outer peripheral surface of the fuel line 5, forms a pressure receiving surface, to which a pressing force is transmitted by means of a pressure transmission arrangement coaxially surrounding the fuel line 5. The pressing force is produced by a cap screw element 15 formed by a pressure screw being screwed into a female screwthread 16 of a portion of the passage 4, that directly adjoins the inlet opening 3, to such an extent that a tube portion 17 of the cap screw element 15, that projects into the passage 4, firstly comes to bear against the end that faces theretowards of the pressure transmission arrangement and then displaces it in the direction towards the nozzle holder 2.

In the embodiment shown in FIG. 1 in the finished assembled condition the pressure transmission arrangement comprises a substantially hollow-cylindrical pressure ring which is supported in the assembled condition against the pressure receiving surface of the shoulder 11, a hollow-cylindrical pressing tube 19 which adjoins the pressure ring 18 and which bridges over the major part of the length of the passage 4, and a hollow-cylindrical sealing sleeve 20 against which the inner end of the tube portion 17 of the cap screw element 15 bears.

In the production of the fuel line 5 the pressure nipple 6 is firstly formed by upsetting on the tube forming the fuel line, whereupon then the individual parts of the pressure transmission arrangement are pushed on from the end that has not yet been deformed and on which then a pressure or sealing nipple is generally also produced by upsetting.

To permit the pressure ring 18 and the pressing tube 19 to be pushed on to the fuel line 5 the inside diameter of each of those components must be somewhat larger than the outside diameter of the fuel line 5, whereby between those components there is a continuous hollow-cylindrical free space 21 which is of a very small internal width and which is not directly visible in FIG. 1 by virtue of the scale selected for FIG. 1 but is only indicated by the end point of the reference line.

In addition the inside diameter of the passage 4 must be larger than the outside diameter of the pressure ring 18 and the pressing tube 19 so that the fuel line which is surrounded by those components can be pushed into the passage 4. The hollow-cylindrical free space 22 which is afforded thereby must be markedly larger than the free space 21 to permit assembly.

The two above-mentioned free spaces 21, 22 must be sealed off relative to the exterior in order to prevent both the escape of leakage fuel and/or engine oil which could penetrate into them from the engine and on the other hand the ingress of moisture from the outside atmosphere.

In the embodiment illustrated in FIG. 1 sealing of the two free spaces 21, 22 is effected by means of the above-mentioned sealing sleeve 20 whose inside and outside diameters are so matched to the outside diameter of the tubular fuel line 5 and the inside diameter of the passage 4 respectively that it is just still possible for same to be inserted. The actual sealing function is afforded by three sealing rings 24, 25 and 26 which comprise an elastic material that is resistant to engine oil and fuel and of which the first-mentioned is arranged in a groove which is incorporated in the wall of the sealing sleeve 20 approximately at the center of its axial length from the outside and extends around the periphery thereof while the other two are fitted in grooves which are incorporated into the wall of the sealing sleeve 20 from the inside at approximately equal axial spacings from the center of the axial length of the sealing sleeve 20.

As an alternative thereto two or more grooves with sealing elements arranged therein can also be provided in the outside of the wall of the sealing sleeve 20 and only one or more than two grooves with sealing elements arranged therein can be provided in the inside of the wall of the sealing sleeve 20.

It is essential that all sealing elements in the assembled condition bear against the inside wall of the passage 4 and the outside wall of the fuel line 5 respectively in such a way that neither moisture can pass from the outside inwardly nor can oil or fuel pass from the inside outwardly.

FIG. 2 only shows a part of a section similar to FIG. 1 through a further embodiment in which the cap screw element 15 is not yet screwed completely into the female screwthread 16 of the passage 4 and therefore does not yet bear with its inwardly disposed end against the sealing sleeve 28 which concentrically surrounds the tubular fuel line 5 and which here in principle performs the same function as the sealing sleeve 20 of the embodiment described with reference to FIG. 1. In contrast thereto however it does not have any peripherally extending grooves in its inside and outside surfaces respectively, for receiving sealing rings, but it has two rabbets or notches of which the one is provided in the transitional region between the outer peripheral surface and the end face of the sealing sleeve 28, that is towards the pressing tube 19, and the other is provided in the transitional region between the inner peripheral surface and the end face of the sealing sleeve 28, that is towards the cap screw element. Fitted into each of those notches is a sealing ring 30 and 31 respectively, whose axial length is such that in the condition shown in FIG. 2 in which it is not yet finally assembled, it projects out of its associated notch in the axial direction beyond the end face in question of the sealing sleeve 28. In addition the sealing rings 30, 31 are each of a radial thickness or wall thickness which is not greater than the radial depth of the notch in question so that in the condition shown in FIG. 2 they do not bear against the inside wall of the passage 4 or the outside wall of the line 5, whereby the assembly procedure is considerably facilitated as no particular frictional forces have to be overcome.

When then, as shown in FIG. 3, the cap screw element 15 is screwed entirely into the female screwthread 16 and tightened the inner end of the tube portion 17 moves into the passage 4 to such an extent that it comes to bear against the end facing theretowards of the sealing sleeve 28 and displaces it in the direction of the nozzle holder 2 (see FIG. 1) to such an extent that the inward end of the sealing sleeve 28 comes to bear against the outwardly directed end of the pressing tube 19 so that in that way the sealing surface 8 of the pressure nipple 6 is pressed in sealing relationship against the counterpart sealing surface 10 of the nozzle holder by the force produced when the cap screw element 15 is screwed in. At the same time the two sealing rings 30, 31 are compressed in the axial direction whereby they expand in the radial direction so greatly that they afford the desired sealed closure of the free spaces 21 and 22 respectively between the sealing sleeve 28 on the one hand and the inside wall of the passage 4 and the outside wall of the fuel line 5 on the other hand.

In the embodiment shown in FIGS. 4 and 5 the sealing arrangement positioned between the cap screw element 15 and the pressing tube 19 includes three annular disks 34, 35, 36 comprising a strong material, for example steel, that is to say which is practically non-deformable under the axial forces occurring when the cap screw element 15 is tightened, the annular disks 34, 35, 36 being arranged in succession in the axial direction and concentrically surrounding the fuel line 5. The two annular disks 34, 36 which are the outer disks in the axial direction are of an inside diameter which is somewhat larger than the outside diameter of the fuel line 5 so that in the assembly procedure they can be easily pushed thereonto. Mounted on the outside periphery of each of those two annular disks 34, 36 is a sealing ring 37, 39 whose axial length is greater than that of the associated annular disk 34 and 36 respectively so that, in the condition shown in FIG. 4 in which the cap screw element 15 has not yet been screwed sufficiently far into the female screwthread 16 of the passage 4, the sealing ring projects in the axial direction beyond the end faces thereof. The outside diameter of each of those sealing rings 37, 39 is initially, that is to say without axial compression, somewhat smaller than the inside diameter of the passage 4 so that, upon insertion of the annular disks 34, 36 provided with those sealing rings 37, 38 into the passage 4, no substantial frictional forces have to be overcome.

The third annular disk 35 arranged between the other two annular disks is of an outside diameter somewhat smaller than the inside diameter of the passage 4 and carries a sealing ring 38 which is fitted into its central opening and which in the non-compressed condition (see FIG. 4) projects in the axial direction beyond the end faces thereof and is of an inside diameter larger than the outside diameter of the fuel line 5. Those dimensions provide that no substantial frictional forces also occur upon fitment of the annular disk 35.

It is only when, as shown in FIG. 5, the cap screw element 15 is completely screwed in and tightened, that the axial force exerted in that case causes compression in the axial direction of the sealing rings 37, 38 and 39 between the end faces of the tube portion 17, the annular disks 34, and 36 and the pressing tube 19, whereby they expand in the radial direction and thus press against the inside wall of the passage 4 and the outside wall of the fuel line 5 so that the desired sealed closure of the free spaces 21 and 22 is achieved.

As an alternative to the advantageous embodiment just described the sealing arrangement may also include only two or more than three annular disks, in which case then annular disks corresponding to the annular disks 34 and 36 on the one hand and the annular disk 35 on the other hand are always arranged alternately.

The embodiment shown in FIGS. 6 and 7, similarly to FIG. 1, has a sealing sleeve 40 which concentrically surrounds the tubular fuel line 5 and which forms a part of the pressure transmission arrangement, in the region between the end, facing towards the nozzle holder 2, of the tube portion 17 of the cap screw element 15 and the end, remote from the nozzle holder 2, of the pressing tube 19, but that sealing sleeve 40 only has a single sealing element which is formed by a sealing ring 41 and which is arranged in the same manner as the outwardly disposed sealing ring 24 of the example described with reference to FIG. 1; it thus provides only for sealing of the free space 22 between the inside wall of the passage 4 and the outside wall of the pressing tube 19.

Here, the free space 21 between the outside wall of the fuel line 5 and the inside wall of the pressing tube 19 is sealed by a hollow-cylindrical sealing body 43 of an elastomer material which is resistant to engine oil and/or fuel and which is disposed in an enlargement of the bore passing through the tube portion 17 of the cap screw element 15 and coaxially surrounds the fuel line 5. The axial length of that sealing body 43 is somewhat greater than that of the enlargement of the bore in the tube portion 17 so that it projects somewhat in the axial direction therefrom as shown in FIG. 6 as long as the cap screw element 15 has not yet been completely screwed into the passage 4 and tightened, in assembly of the arrangement.

When the cap screw element 15 is definitively tightened the projecting end of the sealing body 43 then comes to bear against the opposite end edge of the sealing sleeve 40 and in the further course of being screwed tight is compressed by the counteracting force which is exerted by the pressure nipple 6 bearing against the counterpart sealing surface 10 of the nozzle holder 2 on the pressing tube 19 by way of the pressure ring 18. That compression causes an increase in the radial thickness of the sealing body 43 so that it bears firmly against the inside of the enlargement of the bore in the tube portion 17, the fuel line 5 and the end face that faces towards it of the sealing sleeve 40, and sealingly closes the free space 21 between the outside wall of the fuel line 5 and the inside wall of the pressing tube 19 relative to the external region, as shown in FIG. 7.

Here too the sealing sleeve 40 may carry more than one sealing ring on its outside.

The embodiment of FIG. 8 does not have a sealing sleeve which coaxially surrounds the tubular fuel line 5 and which is arranged between the tube portion 17 of the cap screw element 15 and the pressing tube 19. The pressing tube 19 is correspondingly longer so that upon assembly a sealing body 45 which is of a configuration and arrangement like the sealing body 43 in FIG. 7, instead of being compressed by the axially outwardly directed end of a sealing sleeve when the cap screw element 15 is tightened, is compressed by the corresponding end of the pressing tube 19 in the same manner as was described hereinbefore, whereby a sealed closure is provided in respect of the free space 21 between the outside wall of the fuel line 5 and the inside wall of the pressing tube 19 with respect to the external region of the cylinder head 1.

In addition the female screwthread 16 of the passage 4, into which the cap screw element 15 is screwed in the assembly procedure, is arranged displaced in the axial direction further towards the nozzle holder 2 and the passage 4 has in directly adjoining relationship to its inlet opening 3 a hollow-cylindrical sealing region 47 of a larger diameter than the female screwthread 16 adjoining it and the portion therebehind of the passage 4 surrounding the pressing tube 19 so that a radially extending peripherally extending shoulder 48 is formed at the transition from the sealing region 47 to the region of the female screwthread 16.

The cap screw element 15 has a shaft portion 50 which is adjoined in the axial direction by the tube portion 17 to be screwed into the female screwthread 16 of the passage 4. That shaft portion 50 is of a larger outside diameter than the tube portion 17 so that there is also a radially and peripherally extending shoulder 51 on the cap screw element 15 between those two portions.

The axial lengths of the shaft portion 50 of the cap screw element 15 and of the sealing region 47 of the passage 4, that adjoins the inlet opening 3, are so matched to each other that, in the completely assembled condition in which the cap screw element 15 is firmly tightened, the shoulder 51 is closer in the axial direction to the inlet opening 3 than the shoulder 48 so that what remains between those two shoulders 51, 48 is a free space 53 which is in fluid communication by way of the screw means which does not form a sealed closure between the cap screw element 15 and the female screwthread 16, with the free space 22 between the inside wall of the passage 4 and the outside wall of the pressing tube 19 so that engine oil or fuel there can transfer into the free space 53.

So that it does not pass uncontrolledly outwardly out of same, provided in the outside wall of the shaft portion 50 of the cap screw element 15 is a groove which extends over the periphery and in which is disposed a sealing ring 54 which in the assembled condition bears firmly against the inside wall of the sealing region 47 of the passage 4 and provides for a sealed closure in relation to the exterior. A discharge flow passage can pass away from the free space 53 between the shoulders 48 and 51, and controlled discharge and return of a fluid (engine oil or fuel) which has penetrated into the free spaces 22 and 53 can possibly occur by way of the discharge flow passage.

As can be seen from the foregoing description all sealing elements which are required to seal off the free spaces 21 and 22 relative to the exterior are thus disposed within the passage 4 in each of the embodiments and no additional screw elements are required to achieve compression of those sealing elements, that ensures good sealing integrity even at high pressures.

The invention claimed is:

1. A connecting arrangement for a tubular fuel line (5) which coming from the exterior extends through a passage (4) in a cylinder head (1) to a nozzle holder (2) of an injection nozzle to feed fuel thereto, wherein at its front end towards the nozzle holder (2) the fuel line (5) has a pressure nipple (6) which on its front side has a sealing surface (8) and on its rear side a pressure receiving surface, wherein the connecting arrangement includes the following:

a cap screw element (15) which coaxially surrounds the fuel line (5) and which is screwed in the region of the inlet opening (3) of the passage (4) and which projects with an axially directed tube portion (17) into the passage (4), a pressure transmission arrangement which is arranged in the interior of the passage (4) and which coaxially surrounds the fuel line (5) and on which the tube portion (7) of the cap screw element (15) in the tightened condition exerts a force which is directed axially towards the nozzle holder (2) and which is transmitted thereby to the pressure receiving surface of the pressure nipple (6) to press the sealing surface (8) thereof against a counterpart sealing surface (10) which is provided on the nozzle holder (2) and which surrounds the mouth opening of a fuel flow passage leading further in the nozzle holder (2), and a sealing arrangement which seals off a first free space (21) between the outside wall of the fuel line (5) and the inside wall of the pressure transmission arrangement and a second free space (22) between the outside wall of the pressure transmission arrangement and the inside wall of the passage (4) towards the exterior of the cylinder head (1), characterized in that the sealing arrangement is positioned completely in the interior of the passage (4).

2. A connecting arrangement as set forth in claim 1 characterized in that the sealing arrangement includes a sealing sleeve (20; 28; 40) which coaxially surrounds the fuel line (5) and which is arranged between the inwardly directed end of the tube portion (17) of the cap screw element (15) and the end of a pressing tube (19) that is remote from the nozzle holder (2) and which transmits to the pressing tube (19) the force exerted by the cap screw element (15) upon being screwed in.

3. A connecting arrangement as set forth in claim 2 characterized in that in its outside and inside walls the sealing sleeve (20) has respectively at least one peripherally extending recess into which a sealing ring (24, 25, 26) is fitted.

4. A connecting arrangement as set forth in claim 2 characterized in that at least one of the recesses in the outside wall of the sealing sleeve (20) is a peripherally extending groove into which is fitted a sealing ring (24) which projects in the radial direction outwardly beyond the outer peripheral surface of the sealing sleeve (20) to such an extent that in the assembled condition it bears sealingly against the inside wall of the passage (4) and that at least one of the recesses in the inside wall is a peripherally extending groove into which is fitted a sealing ring (25, 26) which projects in the radial direction inwardly beyond the inner peripheral surface of the sealing sleeve (20) to such an extent that in the assembled condition it bears sealingly against the outside wall of the fuel line (5).

5. A connecting arrangement as set forth in claim 2 characterized in that at least one of the recesses in the outside wall of the sealing sleeve (28) is a notch which is disposed in the transitional region between the one end and the outer peripheral surface of the sealing sleeve (28) and into which is fitted a sealing ring (30) which prior to the tightening of the cap screw element (15) projects in the axial direction beyond the end face in question of the sealing sleeve (28) and does not extend in the radial direction as far as the inside wall of the passage (4) and that at least one of the recesses in the inside wall of the sealing sleeve (28) is a notch which is disposed in the transitional region between the other end and the inner peripheral surface of the sealing sleeve (28) and into which is fitted a sealing ring (31) which prior to the tightening of the cap screw element (15) projects in the axial direction beyond the end face in question of the sealing sleeve (28) and does not extend in the radial direction as far as the outside wall of the fuel line (5) and after tightening of the cap screw element (15) by virtue of axial upsetting the two sealing rings (30, 31) are expanded in the radial direction to such an extent that they bear sealingly against the inside wall of the passage (4) and the outside wall of the fuel line (5) respectively.

6. A connecting arrangement as set forth in claim 1 characterized in that the sealing arrangement includes at least two circular annular disks (34, 35, 36) which concentrically surround the fuel line (5) and of which a first (34) is of an inside diameter somewhat larger than the outside diameter of the fuel line (5) and of which at least a second (35) is of an outside diameter somewhat smaller than the inside diameter of the passage (4) and the at least one first annular disk (34) carries on its outer periphery a sealing ring (37) which projects in the axial direction beyond the two end faces thereof and whose outside diameter prior to the tightening of the cap screw element (15) is somewhat smaller than the inside diameter of the passage (4) and the at least one second annular disk (25) in its central opening carries a sealing ring (38) which projects in the axial direction beyond the two end faces thereof and whose inside diameter prior to the tightening of the cap screw element (15) is somewhat larger than the outside diameter of the fuel line (5) and the two sealing rings (37, 38) after the tightening of the cap screw element (15) by virtue of axial upsetting are expanded in the radial direction to such an extent that they bear sealingly against the inside wall of the passage (4) and the outside wall of the line (5) respectively.

7. A connecting arrangement as set forth in claim 1 characterized in that the continuous inner bore of the cap screw element (15) has in the region of the tube portion (17) an enlargement which is open towards the nozzle holder (2) and into which is fitted a hollow-cylindrical sealing body (43) whose inside diameter is somewhat larger than the outside diameter of the fuel line (5) and which prior to the tightening of the cap screw element (15) projects in the axial direction out of the tube portion (17) and after the tightening of the cap screw element (15) by virtue of axial upsetting is expanded in the radial direction to such an extent that it bears sealingly against the inside wall of the enlargement of the inner bore of the cap screw element (15) and against the outside wall of the fuel line (5).

8. A connecting arrangement as set forth in claim 7 characterized in that the cap screw element (15) has a peripherally extending groove on the outside surface of a shaft portion (15) projecting into the passage (4), a sealing ring (54) bearing sealingly against the inside wall of the passage being fitted in the peripherally extending groove.

9. A connecting arrangement as set forth in claim 1 characterized in that the cap screw element (15) is in the form of a cap screw and is screwed into a female screwthread (16) formed in the region of the inlet opening (3) of the passage (4) in the inside wall of the latter.

10. A connecting arrangement as set forth in claim 1 characterized in that provided between the end of the pressing tube (19), that is towards the nozzle holder (2), and the pressure receiving surface of the pressure nipple (6), there is a pressure ring (18) which coaxially surrounds the fuel line (5) and which transmits to the pressure nipple (6) from the pressing tube (9) the axially directed force produced upon tightening of the cap screw element (15).

* * * * *